US005630370A

United States Patent [19]

Herbach

[11] Patent Number: 5,630,370

[45] Date of Patent: May 20, 1997

[54] DEVICE FOR DETACHABLY FASTENING AN EMBROIDERY FRAME

[75] Inventor: Mathias Herbach, Pfinztal, Germany

[73] Assignee: G.M. Pfaff Aktiengesellschaft, Kaiserslautern, Germany

[21] Appl. No.: 648,337

[22] Filed: May 15, 1996

[30] Foreign Application Priority Data

May 19, 1995 [DE] Germany ..... 295 08 373.5

[51] Int. Cl.[6] ..... D05C 9/04

[52] U.S. Cl. ..... 112/103

[58] Field of Search ..... 112/103, 102, 112/102.5, 470.06, 470.09, 470.14, 475.18; 38/102.2; 160/371, 372, 380

[56] References Cited

U.S. PATENT DOCUMENTS

| | | | |
|---|---|---|---|
| 5,353,725 | 10/1994 | Sakakibara | 112/103 |
| 5,355,792 | 10/1994 | Macnaughton et al. | 38/102.2 X |
| 5,555,828 | 9/1996 | Rowley | 112/103 |

FOREIGN PATENT DOCUMENTS

| | | | |
|---|---|---|---|
| 3201014C1 | 10/1983 | Germany . | |
| 4208726A1 | 9/1992 | Germany . | |
| 1260052 | 10/1989 | Japan | 112/103 |

*Primary Examiner*—Ismael Izaguirre
*Attorney, Agent, or Firm*—McGlew and Tuttle

[57] ABSTRACT

A device is provided for detachably fastening an embroidery frame, slidingly arranged on a support surface, to a drive member of a feed mechanism of a sewing or embroidery machine. The device includes a coupling device acting in a positive-locking manner and nonpositively acting locking device. Two coupling pins, which are located at mutually spaced locations from one another in the horizontal direction and carry a head each, are fastened to the said embroidery frame. A holding element is fastened to the drive member and contains two elongated holes, which extend in parallel to the said support surface of the machine and whose height corresponds to the diameter of the said coupling pins. A free space is provided in the area of the elongated holes for the heads of the said coupling pins. The elongated holes are offset in relation to one another in the parallel direction at right angles to their longitudinal extension and have a hole each for the entry and withdrawal of the said coupling pins, which take place at right angles to the longitudinal axis of the pin. A spring element is provided including a handle. The spring element can be moved to and fro between two end positions. The spring element snaps into a depression provided on the embroidery frame when the said embroidery frame is inserted with the said coupling pins into the said elongated holes.

6 Claims, 2 Drawing Sheets

DEVICE FOR DETACHABLY FASTENING AN EMBROIDERY FRAME

FIELD OF THE INVENTION

The present invention pertains to a device for detachably fastening an embroidery frame slidingly arranged on a support surface to a drive member of a feed mechanism of a sewing or embroidery machine with coupling means acting in a positive-locking manner and with nonpositively acting locking means.

BACKGROUND OF THE INVENTION

A workpiece holder comparable to an embroidery frame, which can be detachably fastened by means of a device to a drive member of a sewing machine that can be moved in parallel to a support surface for the workpiece holder, has been known from DE 42 08 726 A1. The fastening device contains a pair of pins, which are provided with a head and are arranged either on the workpiece holder or on the drive member, and a pair of engaging grooves, which can be engaged with the pins and are formed on the other of the two parts. The pins and the grooves form coupling means acting in a positive-locking manner, wherein the workpiece holder is coupled on and off by a movement directed at right angles to the support surface. A cam-shaped finger, which is fastened to the workpiece holder or to the drive member and cooperates with a leaf spring of a corresponding shape arranged on the respective other part, is used for the nonpositive locking of the coupled workpiece holder. Since the workpiece holder is guided freely by hand during the coupling and uncoupling, which takes place in the vertical direction, it may easily happen that it assumes an oblique position and that the pins will be jammed in the engaging grooves as a consequence of this.

This risk is avoided in the fastening device for an embroidery frame known from DE 32 01 014 C1 by the embroidery frame always lying on the support surface of the machine during the coupling and uncoupling. The fastening device comprises a T-shaped holding element, which is arranged on the outside of the embroidery frame and can be fastened to the drive member of the machine by means of a fixed stop and a movable stop in the manner of a spring-loaded detent pawl. To make it possible to correctly engage and disengage the T-shaped holding element with the drive-side coupling elements, which are in a hidden location, during coupling and uncoupling, the operator must, however, perform a combined pushing and pivoting movement with the embroidery frame, which always requires a comparatively great skill to be properly successful.

SUMMARY AND OBJECTS OF THE INVENTION

The primary object of the present invention is therefore to provide an easy-to-operate fastening device for an embroidery frame.

According to the invention, a device is provided for detachably fastening an embroidery frame, slidingly arranged on a support surface, to a drive member of a feed mechanism of a sewing or embroidery machine. The device includes coupling means acting in a positive-locking manner and nonpositively acting locking means. Two coupling pins, which are located at mutually spaced locations from one another in the horizontal direction and carry a head each, are fastened to the said embroidery frame. A holding element is fastened to the drive member and contains two elongated holes, which extend in parallel to the said support surface of the machine and whose height corresponds to the diameter of the said coupling pins. A free space is provided in the area of the elongated holes for the heads of the said coupling pins. The elongated holes are offset in relation to one another in the parallel direction at right angles to their longitudinal extension and have a hole each for the entry and withdrawal of the said coupling pins, which take place at right angles to the longitudinal axis of the pin. A spring element is provided including a handle. The spring element can be moved to and fro between two end positions. The spring element snaps into a depression provided on the embroidery frame when the said embroidery frame is inserted with the said coupling pins into the said elongated holes.

Due to the measure of arranging the elongated holes associated with the coupling pins offset in relation to one another in the horizontal direction, wherein they extend in two vertical planes located at mutually spaced locations, the coupling and uncoupling of the embroidery frame can be performed in a particularly simple manner, because the embroidery frame needs to be moved along and in contact with the holding element having the elongated holes only with the lateral surface carrying the coupling pins. During this exclusively linear movement of the embroidery frame, the coupling pins of the embroidery frame enter the elongated holes or are removed therefrom without any additional action, and the pin heads enter the free space accommodating them or are removed therefrom in the same manner, and they form a mount acting in the axial direction of the coupling pins within the free space in cooperation with the wall parts of the holding element which limit the elongated holes. The embroidery frame is fixed in the transverse direction in the coupled position by the spring element.

It is particularly advantageous here that the fastening points of the embroidery frame are located at an especially closely spaced location from the center of the frame. This results in the generation of comparatively low powers of reaction during the acceleration and deceleration of the embroidery frame, which in turn has a favorable effect on the vibration behavior of the embroidery frame.

The holding element is preferably formed by a holding plate, which is fastened to the said drive member at a spaced location and is bent between the said two elongated holes. One elongated hole is open toward one of the faces of the holding plate and forms an opening there. The other elongated hole opens into a recess, which is located in the bent are. The other elongated hole has a height which is greater than a diameter of the pin head associated with it. The surface of the embroidery frame facing the holding plate has a shape corresponding to the bent shape of the holding plate.

The spring element is preferably in contact in the locked position with an oblique shoulder. This limits the recess in a pretensioned state. The shoulder preferably is provided on a laterally projecting projection of the embroidery frame. The spring element is formed by an essentially T-shaped spring clip whose longitudinal leg is mounted on the said holding plate and is anchored with its end on the holding plate, adapted to rotate in unison. One leg part of the transverse leg of the spring element (spring clip) forms a handle, and the other leg part forms a spring stop engaging the shoulder.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
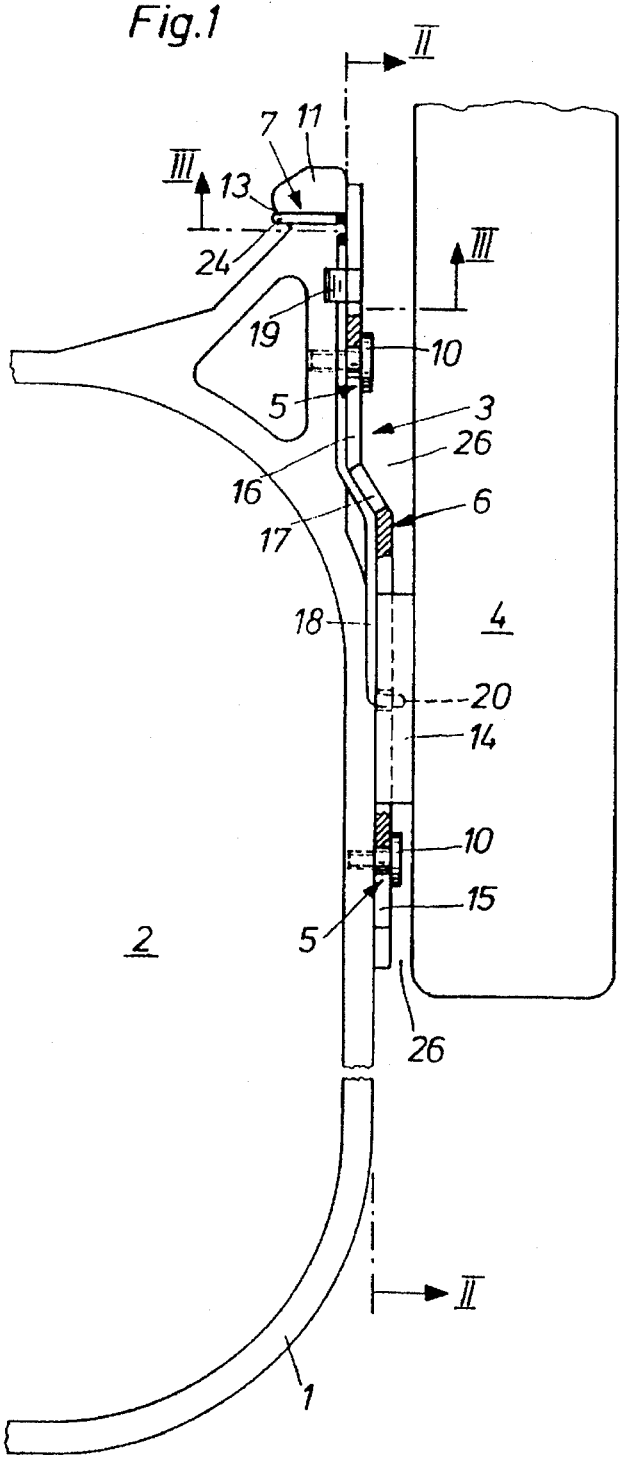
FIG. 1 is a top view of the fastening device of a partially represented embroidery frame, which is coupled with a drive member of a sewing or embroidery machine.
Figure 2:
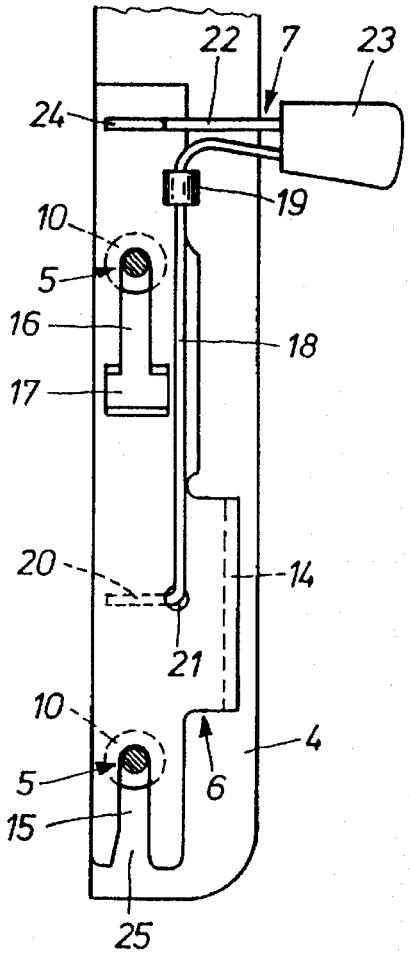
FIG. 2 is a sectional view of the fastening device according to line II—II in FIG. 1.

Referring to the drawings in particular, to carry out embroidery work, the workpiece to be embroidered is clamped in the known manner in an embroidery frame 1. Only part of the outer frame is shown in the drawings. The embroidery frame 1 lies on the support surface 2 of a sewing or embroidery machine, which is a prior-ann machine and is therefore not shown in greater detail. The embroidery frame 1 can be detachably fastened to a schematically represented drive member 4 of the sewing or embroidery machine by means of a device 3, and it can be moved along on the support surface 2 in any desired direction by means of the drive member 4. The general arrangement and the mobility of the embroidery frame 1 is similar to the state of the ann as is disclosed in, e.g., the above-mentioned DE 42 08 726 A1.

The fastening device 3 according to the invention comprises essentially two coupling pins 5 fastened to the embroidery frame 1 and a holding plate 6, which is fastened to the drive member 4, is used to accommodate the coupling pins 5, and forms a coupling means acting in a positive-locking manner together with the pins 5, as well as a spring clip 7 as a locking means acting in a nonpositive manner.

Figure 4:
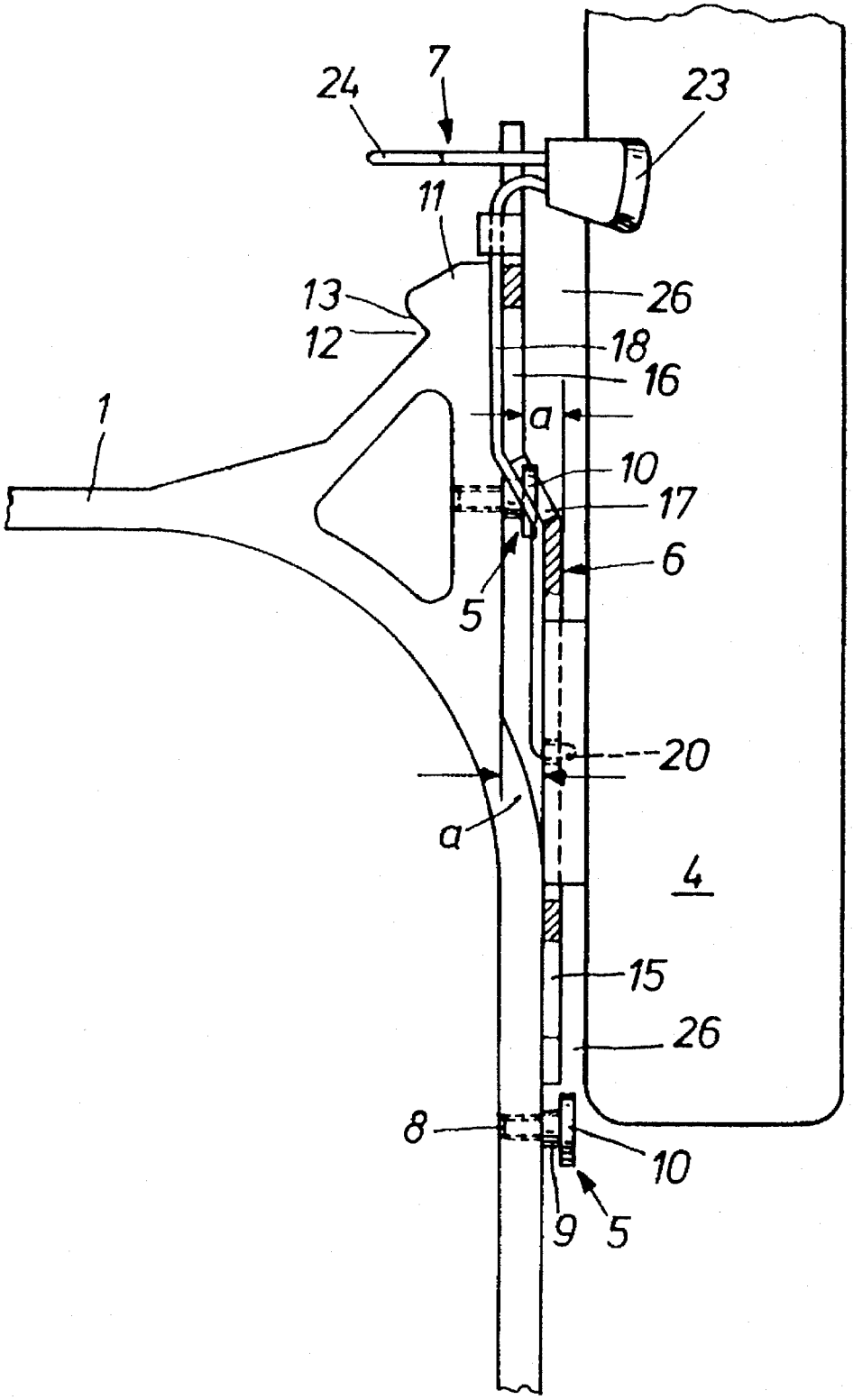
FIG. 4 is a top view similar to that in FIG. 1, but with the embroidery frame uncoupled.

The coupling pins 5 comprise a threaded part 8, a shaft part 9, and a head 10 (FIG. 4). One of the two coupling pins 5 is screwed to the outside of the embroidery frame 1. The second coupling pin 5 is screwed to a lateral projection 11 of the embroidery frame 1, which is offset in the rearward direction relative to the outside of the embroidery frame 1 by the dimension a (FIG. 4). A V-shaped incision 12, whose outer oblique surface forms an oblique shoulder 13, is provided in the end area of the projection 11.

The holding plate 6 is fastened to the drive member 4 by means of a projection piece 14, and it is located at a spaced location therefrom, whereby a free space 26 is formed, which is larger than the axial thickness of the heads 10. The thickness of the holding plate 6 is slightly smaller than the length of the shaft part 9 of the coupling pins 5.

The holding plate 6 is bent approximately in the middle of the above-mentioned dimension a (FIG. 4). It also has two elongated holes 15 and 16, which extend in parallel to the support surface 2 and consequently horizontally, and of which the elongated hole 15 reaches the front face of the holding plate 6 and thus forms an opening 25 at this point. The elongated hole 16 is located in the bent part of the holding plate 6 and opens into a recess (opening) 17 located in the bent area. The height of this recess 17 is greater than the diameter of the head 10 of the corresponding coupling pin 5.

Figure 3:
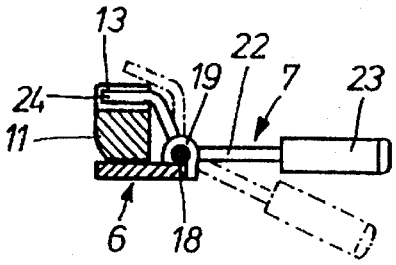
FIG. 3 is a sectional view of a part of the fastening device according to line III—III in FIG. 1.

The above-mentioned spring clip 7 is bent from spring wire and has essentially the shape of a T. Its longitudinal leg 18 is mounted in a ring 19 made in one piece with the holding plate 6 and is passed with a bent-off end 20 through a hole 21 in the holding plate 6 and is anchored as a result at this point, adapted to rotate in unison. The upwardly directed part of the transverse leg 22 of the spring clip 7 carries a grip 23 and thus forms a handle. The downwardly directed part of the transverse leg 22 is bent according to FIG. 3 and forms a spring stop 24, which engages the incision 12 and comes into contact with the shoulder 13.

To couple the embroidery frame 1 with the drive member 4, the embroidery frame 1 with its outside is pushed in the rearward direction (upward in relation to the drawing plane), lying on the surface of the holding plate 6 facing it. The front coupling pin 5 with its shaft part 9, which coupling pin is offset in the rearward direction, now enters the elongated hole 16, and its head 10 moves through the recess 17, as a result of which it comes behind the holding plate 6 into the free space 26 between the holding plate 6 and the drive member 4. At the same time, the rear coupling pin 5 with its shaft part 9 enters the elongated hole 15, and its head 10 also comes behind the holding plate 6 and into the said free space 26.

Near the end of the coupling movement, either the spring stop 24 is pivoted out of the way of the projection 11 by pivoting the grip 23, or the oblique outside of the projection 11 pushes the spring stop 24 back laterally. The shaft parts 9 of the coupling pins 5 are in contact with the corresponding end of the elongated hole 15 or 16 associated with them at the end of the coupling process. The spring stop 24 comes into contact in this position with the oblique shoulder 13 in a pretensioned state, and as a result, it causes the coupling pins 5 with their shaft parts 9 to be continuously in a nonpositive contact with the ends of the respective elongated holes 15 and 16 when the embroidery frame 1 is coupled.

It is thus guaranteed that the embroidery frame 1 cannot leave its coupled position by itself during accelerating or decelerating forces occurring in parallel to the longitudinal direction of the holding plate 6 against the direction of the coupling movement. In the case of forces acting at fight angles thereto, the coupling of the embroidery frame 1 is secured by the heads 10 of the coupling pins 5, which extend behind the holding plate 6.

While a specific embodiment of the invention has been shown and described in detail to illustrate the application of the principles of the invention, it will be understood that the invention may be embodied otherwise without departing from such principles.

What is claimed is:

1. A device for detachably fastening an embroidery frame slidingly arranged on a support surface to a drive member of a feed mechanism of a sewing or embroidery machine, the device comprising:

coupling means acting in a positive-locking manner and nonpositively acting locking means, including two coupling pins fastened to the embroidery frame and located at mutually spaced locations from one another in a horizontal direction, each of said coupling pins carrying a head, a holding element fastened to the drive member, said holding element containing two elongated holes, which extend in parallel to the support surface of the machine and which have a height corresponding to a diameter of said coupling pins, a free space provided in an area of said elongated holes for accommodating said heads of said coupling pins, said elongated holes being offset in relation to one another in a parallel direction at right angles to a longitudinal extension of said elongated holes and each elongated hole having an opening for entry and withdrawal of said coupling pins, said entry and withdrawal taking place at fight angles to the longitudinal axis of the pin, a spring element provided with a handle and being movable to and fro between two end positions, said embroidery frame being provided with a depression, said spring element snapping into said depression when the embroidery frame is inserted with said coupling pins into said elongated holes.

2. A device in accordance with claim 1, wherein said holding element is formed by a holding plate which is fastened to the drive member at a spaced location and is bent between said two elongated holes, wherein one of said elongated holes is open toward one face of said holding plate and forms one said opening at said one face, and another of said elongated holes opens into a recess, which recess is located in a bent area of said holding plate, said recess having a height which is greater than a diameter of said pin head associated with said another of said elongated holes, and a surface of the embroidery frame facing said holding plate has a shape corresponding to a shape of said bent area of said holding plate.

3. A device in accordance with claim 2, wherein said spring element is in contact in a locked position with an oblique shoulder of the embroidery frame, said oblique shoulder limiting said recess in a pretensioned state.

4. A device in accordance with claim 3, wherein said shoulder is provided on a laterally projecting projection of said embroidery frame, said spring element being formed by an essentially T-shaped spring clip, said spring clip having a longitudinal leg mounted on said holding plate and being anchored with an end of said spring clip on said holding plate, adapted to rotate in unison with said holding plate, said spring clip having a transverse leg with one leg part of said transverse leg forming a handle, and another leg part of said transverse leg forming a spring stop, said spring stop engaging said shoulder.

5. A device in accordance with claim 1, wherein said spring element is in contact in a locked position with an oblique shoulder of the embroidery frame, said oblique shoulder limiting said recess in a pretensioned state.

6. A device in accordance with claim 5, wherein said shoulder is provided on a laterally projecting projection of said embroidery frame, said spring element being formed by an essentially T-shaped spring clip, said spring clip having a longitudinal leg mounted on said holding plate and being anchored with an end of said spring clip on said holding plate, adapted to rotate in unison with said holding plate, said spring clip having a transverse leg with one leg part of said transverse leg forming a handle, and another leg part of said transverse leg forming a spring stop, said spring stop engaging said shoulder.

* * * * *